US009217281B2

(12) United States Patent
Huang

(10) Patent No.: US 9,217,281 B2
(45) Date of Patent: Dec. 22, 2015

(54) LIGHT ADJUSTING ROLLER BLIND DEVICE AND METHOD FOR MOUNTING THE SAME

(71) Applicant: K.E. & KINGSTONE CO., LTD., Taipei (TW)

(72) Inventor: Wen-Chong Huang, Taipei (TW)

(73) Assignee: K.E. & KINGSTONE CO., LTD. (TW)

( * ) Notice: Subject to any disclaimer, the term of this patent is extended or adjusted under 35 U.S.C. 154(b) by 92 days.

(21) Appl. No.: 14/183,658

(22) Filed: Feb. 19, 2014

(65) Prior Publication Data

US 2015/0233179 A1 Aug. 20, 2015

(51) Int. Cl.

| | |
|---|---|
| ***E06B 9/24*** | (2006.01) |
| ***E06B 9/40*** | (2006.01) |
| *E06B 9/78* | (2006.01) |

(52) U.S. Cl.

CPC ..... *E06B 9/40* (2013.01); *E06B 2009/2405* (2013.01); *E06B 2009/2458* (2013.01); *E06B 2009/785* (2013.01)

(58) Field of Classification Search

CPC ..... E06B 9/78; E06B 2009/2435; E06B 2009/2405; E06B 2009/785

USPC ..... 160/85, 86, 120, 121.1, 244, 265

See application file for complete search history.

(56) References Cited

U.S. PATENT DOCUMENTS

| | | | | | |
|---|---|---|---|---|---|
| 259,156 | A * | 6/1882 | Hopkins | E06B 9/42 | 160/244 |
| 6,189,592 | B1 * | 2/2001 | Domel | E06B 9/24 | 160/241 |
| 7,806,160 | B2 * | 10/2010 | Byeon | E06B 9/40 | 160/11 |
| 7,849,907 | B2 * | 12/2010 | Jang | E06B 9/40 | 160/120 |
| 8,919,415 | B1 * | 12/2014 | Crider | E06B 9/42 | 160/241 |
| 2007/0084568 | A1 * | 4/2007 | Nien | A47H 23/06 | 160/85 |
| 2010/0258255 | A1 * | 10/2010 | Lee | E06B 9/42 | 160/319 |
| 2012/0043029 | A1 * | 2/2012 | Gaskill | E06B 9/42 | 160/121.1 |
| 2013/0240159 | A1 * | 9/2013 | Safarik | E06B 9/26 | 160/168.1 V |

* cited by examiner

*Primary Examiner* — Katherine Mitchell
*Assistant Examiner* — Abe Massad
(74) *Attorney, Agent, or Firm* — Hershkovitz & Associates, PLLC; Abe Hershkovitz

(57) ABSTRACT

A light adjusting roller blind device has a support assembly, and a driving assembly, an adjusting mechanism and a blind assembly mounted on the support assembly. A blind of the blind assembly can be adjusted by simply detaching a second holding part from a first holding part and then releasing a first rope. The blind can be stably lowered along with the releasing of the first rope. Therefore, it is easy and convenient for the user to adjust the blind of the light adjusting roller blind device.

13 Claims, 23 Drawing Sheets

LIGHT ADJUSTING ROLLER BLIND DEVICE AND METHOD FOR MOUNTING THE SAME

BACKGROUND OF THE INVENTION

1. Field of the Invention

The present invention relates to a roller blind device, especially to a light adjusting roller blind device that can be easily and conveniently mounted upon a window frame.

2. Description of the Prior Art(s)

A roller blind device is mounted upon a window and is used for decoration, heat insulation, blocking sunlight, and providing privacy. Due to practicality of the roller blind device, the roller blind device is popular and is widely used. Nowadays, the roller blind device is packaged for sale in a store, so that a user can buy the roller blind device and mount the roller blind device on a window frame of the window or on a wall beside the window by himself. Since the roller blind device is provided for the user to do the mounting by himself, the roller blind device has to be capable of easy mounting.

With reference to FIGS. 18A, 18B, and 19, a conventional light adjusting roller blind device comprises a support assembly 60, a rolling mechanism 61, a roller 65, a blind 62, a lower retaining rod 63, and a bottom retaining weight 64.

The support assembly 60 includes a first support 601, a second support 602, an upper retaining rod 603, and a housing 604. The first support 601 and the second support 602 are disposed apart from each other. The upper retaining rod 603 is mounted between and on the first support 601 and the second support 602. The housing 604 is mounted between and on the first support 601 and the second support 602.

The rolling mechanism 61 is mounted on the first support 601 and includes a chain disk and a beaded cord 610. The beaded cord 610 is mounted around the chain disk and selectively drives the chain disk to rotate.

The roller 65 is mounted between and on the first support 601 and the second support 602, and is driven to rotate by the rolling mechanism 61.

The blind 62 has a first end edge, a second end edge, a folding portion 623, multiple transparent portions 621, and multiple light-blocking portions 622. The first end edge of the blind 62 is connected to and wrapped around the roller 65. The second end edge of the blind 62 is wrapped around the upper retaining rod 603 and protrudes out of the housing 604. The folding portion 623 is defined between the first end edge and the second end edge of the blind 62 and has an interior surface and an exterior surface. The transparent portions 621 and the light-blocking portions 622 are alternately arranged between the first end edge and the second end edge of the blind 62.

The lower retaining rod 63 is transversely mounted in the folding portion 623 of the blind 62 on the interior surface of the folding portion 623.

The bottom retaining weight 64 is mounted on the exterior surface of the folding portion 623 of the blind 62 and has a receiving recess 641 and an adjusting recess 642. The receiving recess 641 and the adjusting recess 642 are oppositely formed on the bottom retaining weight 64. The receiving recess 641 receives the folding portion 623 of the blind 62 and the lower retaining rod 63.

The beaded cord 610 of the rolling mechanism 61 is pulled to drive the chain disk to rotate. As the chain disk rotates, the roller 65 rotates as well to roll the blind 62 up or down. With the transparent portions 621 respectively aligning or misaligning with the light-blocking portions 622, light transmitted through the blind 62 can be adjusted.

With reference to FIGS. 18A to 20, a conventional method for mounting the conventional roller blind device comprises steps of:

(a) Mounting the conventional roller blind device upon a window frame via at least one fastening assembly.

(b) Inspecting light-blocking effect of the conventional roller blind device. The beaded cord 610 of the rolling mechanism 61 is pulled to roll the blind 62. When the lower retaining rod 63 aligns with a lower edge of the window frame, if the transparent portions 621 of the blind 62 respectively align with the light-blocking portions 622 of the blind 62, it means that the conventional roller blind device is properly mounted upon the window frame.

(c) Adjusting the blind 62 if the transparent portions 621 of the blind 62 respectively mis-align with the light-blocking portions 622 of the blind 62. The beaded cord 610 of the rolling mechanism 61 is pulled to roll up the blind 62 until the transparent portions 621 of the blind 62 respectively align with the light-blocking portions 622 of the blind 62. The bottom retaining weight 64 is detached from the folding portion 623 of the blind 62 and the lower retaining rod 63. The second end edge of the blind 62 is mounted into the adjusting recess 642 of the bottom retaining weight 64. Then the second end edge of the blind 62 is pulled away from the support assembly 60 for a specific distance via the bottom retaining weight 64. The bottom retaining weigh 64 is detached from the second end edge of the blind 62, and the bottom retaining weight 64 is mounted, via the receiving recess 641, on the folding portion 623 of the blind 62 and the lower retaining rod 63 again.

(d) Repeating the steps of inspecting the light-blocking effect of the conventional roller blind device and adjusting the blind 62 until the conventional roller blind device has been properly mounted upon the window frame.

However, the bottom retaining weight 64 has to be repeatedly detached from and attached to the folding portion 623 of the blind 62 and the second end edge of the blind 62 in order to process the steps of inspecting the light-blocking effect of the conventional roller blind device and adjusting the blind 62. Therefore, mounting the conventional roller blind device upon the window frame is troublesome. If the user pulls the second end edge of the blind 62 directly with hands rather than with the bottom retaining weight 64, the blind 62, which is soft, is very likely to become oblique and wrinkled.

To overcome the shortcomings, the present invention provides a light adjusting roller blind device and a method for mounting the same to mitigate or obviate the aforementioned problems.

SUMMARY OF THE INVENTION

The main objective of the present invention is to provide a light adjusting roller blind device and a method for mounting the same.

The light adjusting roller blind device has a support assembly, a driving assembly, an adjusting mechanism, and a blind assembly. The driving assembly is mounted on the support assembly and includes a roller and a rolling mechanism. The adjusting mechanism is mounted on the support assembly and includes a reference element, an alignment element, a slider, a first holding part, a second holding part, a first rope, a second rope, and a third rope. The blind assembly is mounted in the support assembly, is connected to the driving assembly and the adjusting mechanism, and includes a blind, a guiding rod, and a retaining weight.

The method for mounting the light adjusting roller blind device comprises steps of:

(a) mounting the light adjusting roller blind device upon a window frame;

(b) inspecting light-blocking effect of the light adjusting roller blind device. When a folding portion of the blind aligns with a lower edge of the window frame, if transparent portions of the blind respectively align with light-blocking portions of the blind, the light adjusting roller blind device is properly mounted upon the window frame; and (c) adjusting the blind if the transparent portions of the blind respectively mis-align with the light-blocking portions of the blind, wherein the driving assembly is driven to roll the blind until the transparent portions of the blind respectively align with the light-blocking portions of the blind; the second holding part is detached from the first holding part of the adjusting mechanism to release the first rope of the adjusting mechanism and to roll down the blind of the blind assembly until the folding portion of the blind aligns with the lower edge of the window frame; and the second holding part is attached to the first holding part again to hold the first rope; and (d) repeating the steps of inspecting the light-blocking effect of the light adjusting roller blind device and adjusting the blind until the light adjusting roller blind device has been properly mounted upon the window frame.

With the adjusting mechanism in the support assembly, a user can adjust the blind by simply detaching the second holding part from the first holding part and then releasing the first rope. The alignment element as well as the blind can be stably lowered along with the releasing of the first rope. Therefore, it is easy and convenient for the user to adjust the blind.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
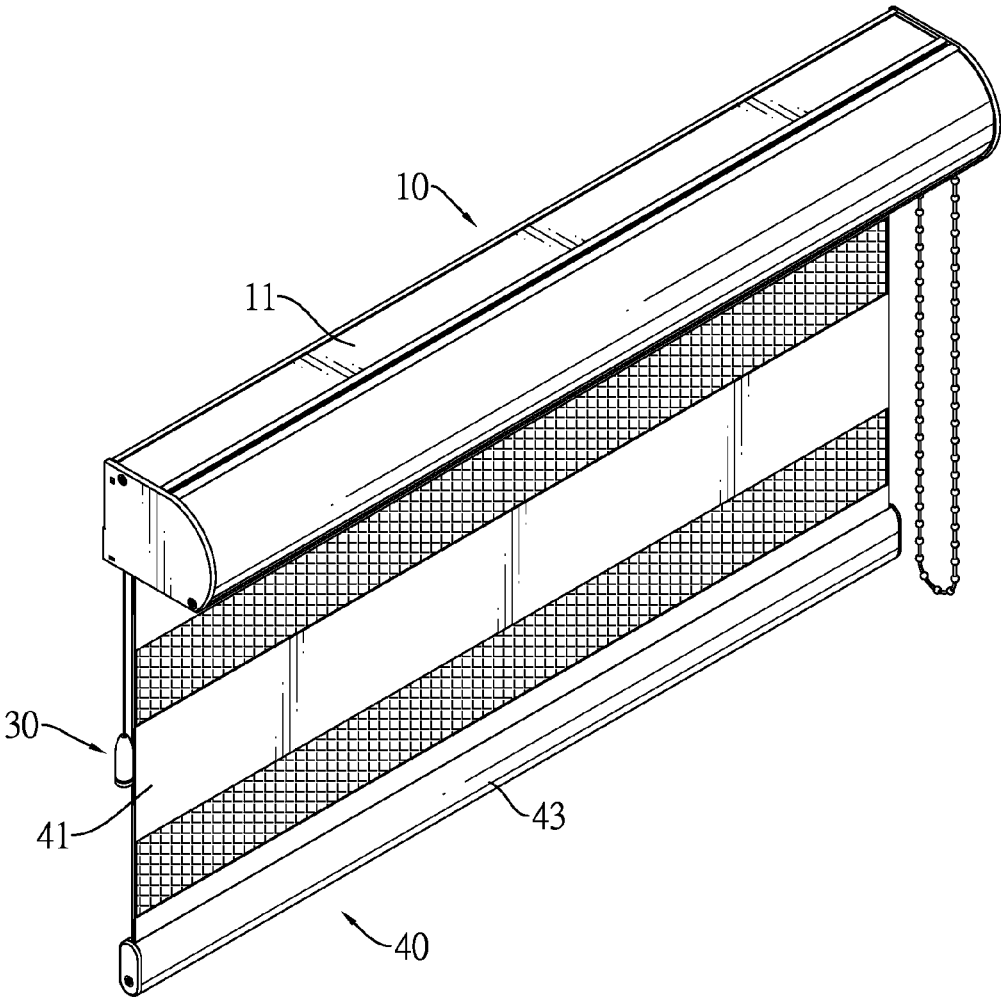
FIG. 1 is a front perspective view of a first embodiment of a light adjusting roller blind device in accordance with the present invention.
Figure 2:
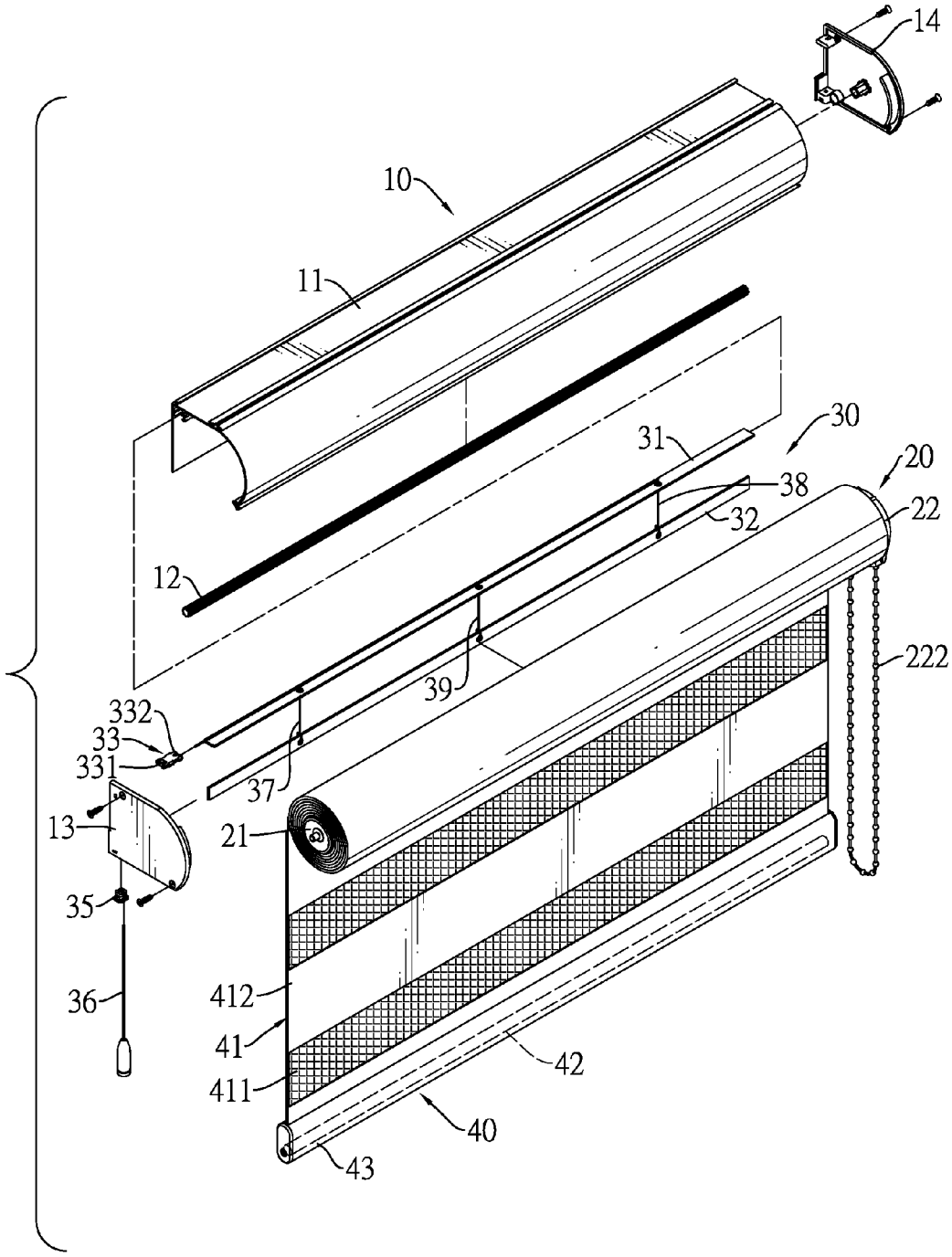
FIG. 2 is an exploded perspective view of the light adjusting roller blind device in FIG. 1.

With reference to FIGS. 1 and 2, a first preferred embodiment of a light adjusting roller blind device in accordance with the present invention comprises a support assembly 10, a driving assembly 20, an adjusting mechanism 30, and a blind assembly 40.

The support assembly 10 includes two side supporting brackets 13, 14, a main supporting bracket 11, and a limit rod 12.

Figure 3:
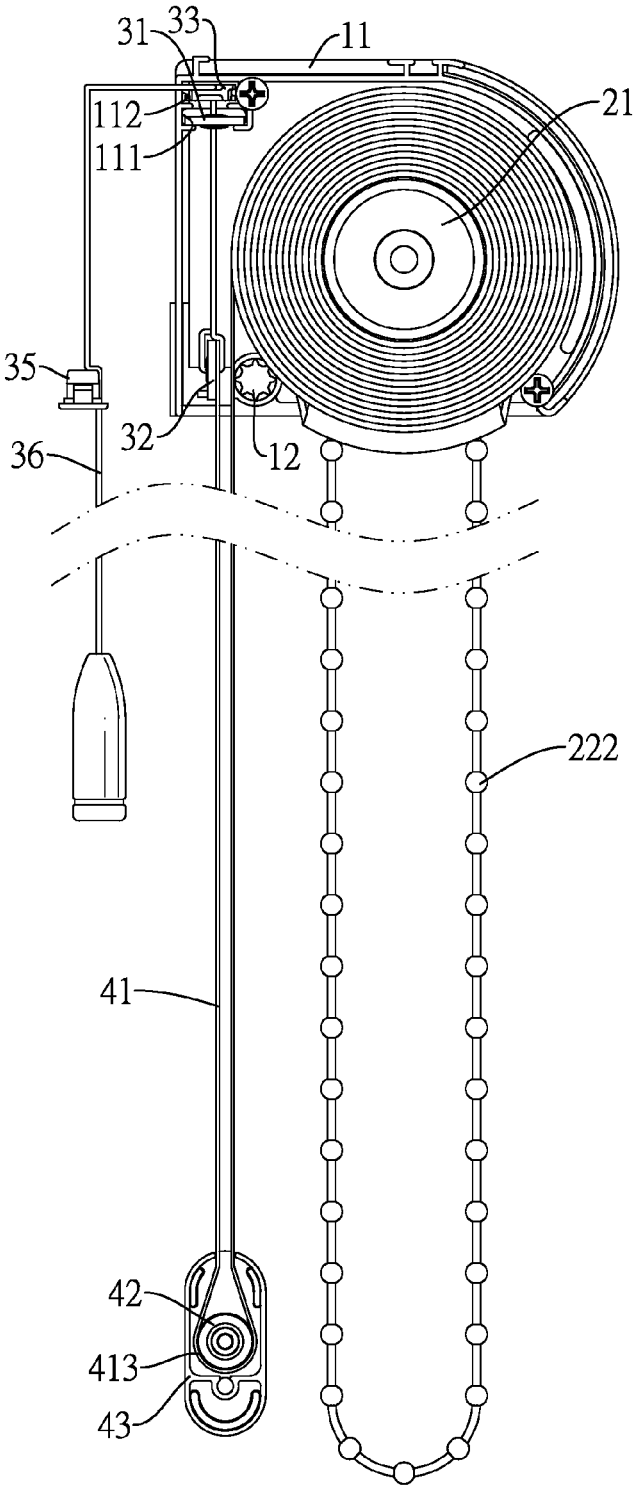
FIG. 3 is an enlarged left side view of the light adjusting roller blind device in FIG. 1.

With reference to FIGS. 1 to 3, the side supporting brackets 13, 14 are disposed apart from each other. The main supporting bracket 11 is mounted between the side supporting brackets 13, 14, and has two opposite ends, a first mounting recess 111 and a second mounting recess 112. The ends of the main supporting bracket 11 are respectively connected to the side supporting brackets 13, 14. The first mounting recess 111 transversely extends on the main supporting bracket 11. The second mounting recess 112 also transversely extends on the main supporting bracket 11, and is disposed beside and communicates with the first mounting recess 111. The limit rod 12 is mounted between the side supporting brackets 13, 14 and has two opposite ends respectively connected to the side supporting brackets 13, 14.

Specifically, the side supporting brackets 13, 14 are a first side supporting bracket 13 and a second side supporting bracket 14. The first mounting recess 111 is disposed below the second mounting recess 112.

Figure 4:
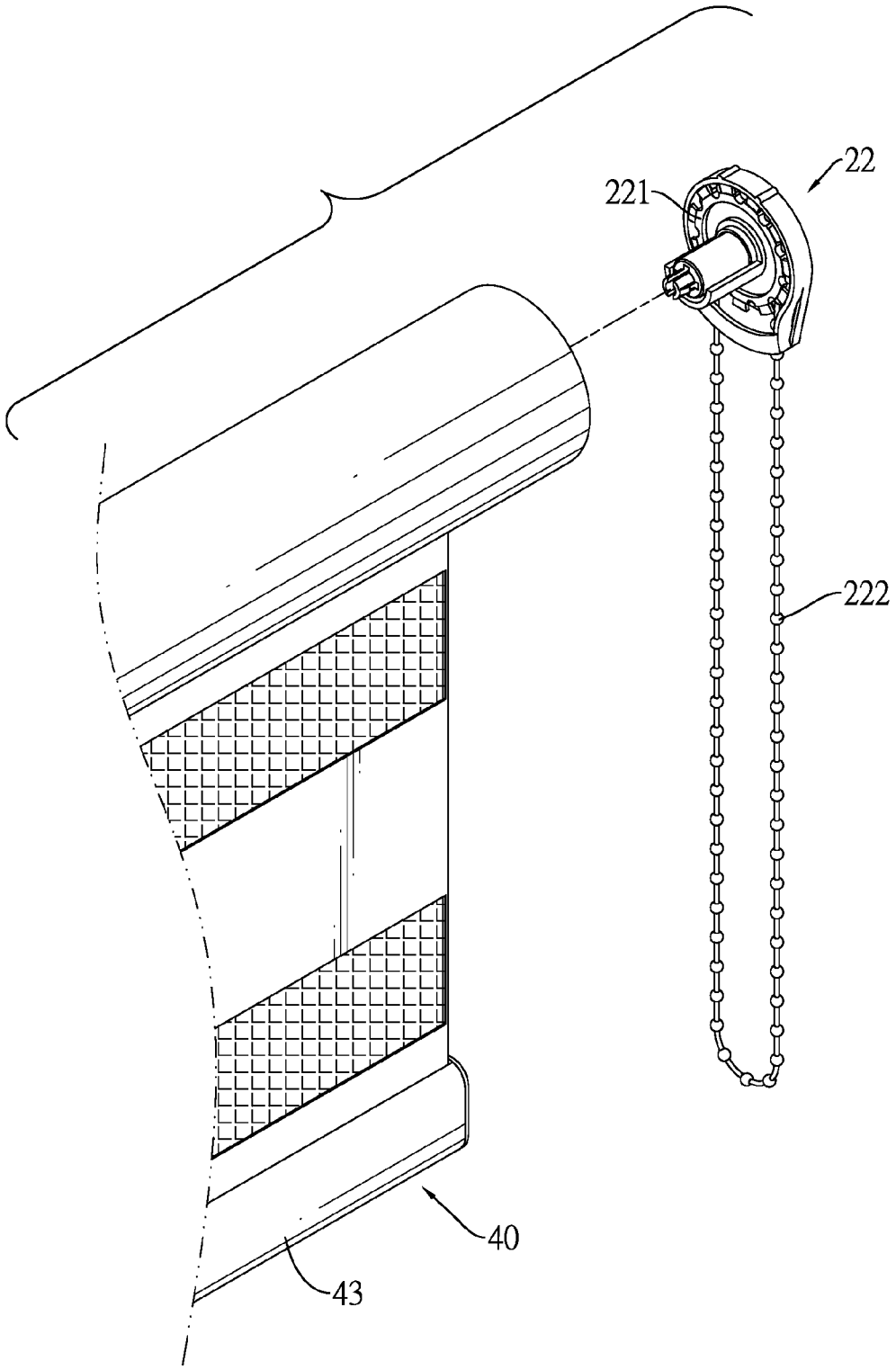
FIG. 4 is a partial exploded perspective view of the light adjusting roller blind device in FIG. 1.

With reference to FIGS. 2 and 4, the driving assembly 20 is mounted on the support assembly 10 and includes a roller 21 and a rolling mechanism 22. The roller 21 is a hollow and cylindrical tube, and is pivotally mounted between and on the side supporting brackets 13, 14 of the support assembly 10. The rolling mechanism 22 is mounted between the roller 21 and the second side supporting bracket 14 of the support assembly 10, is connected to the roller 21, and selectively drives the roller 21 to rotate relative to the support assembly 10. The rolling mechanism 22 includes a chain disk 221 and a beaded cord 222. The chain disk 221 is coaxially connected to the roller 21. The beaded cord 222 is mounted around the chain disk 221. When the beaded cord 222 is pulled, the chain disk 221 is driven to rotate and the roller 21 rotates along with the chain disk 221.

With reference to FIGS. 1, 2, and 5A to 7, the adjusting mechanism 30 is mounted on the support assembly 10 and includes a reference element 31, an alignment element 32, a slider 33, a first holding part 34, a second holding part 35, a first rope 36, a second rope 37, and a third rope 38.

Figure 5A:
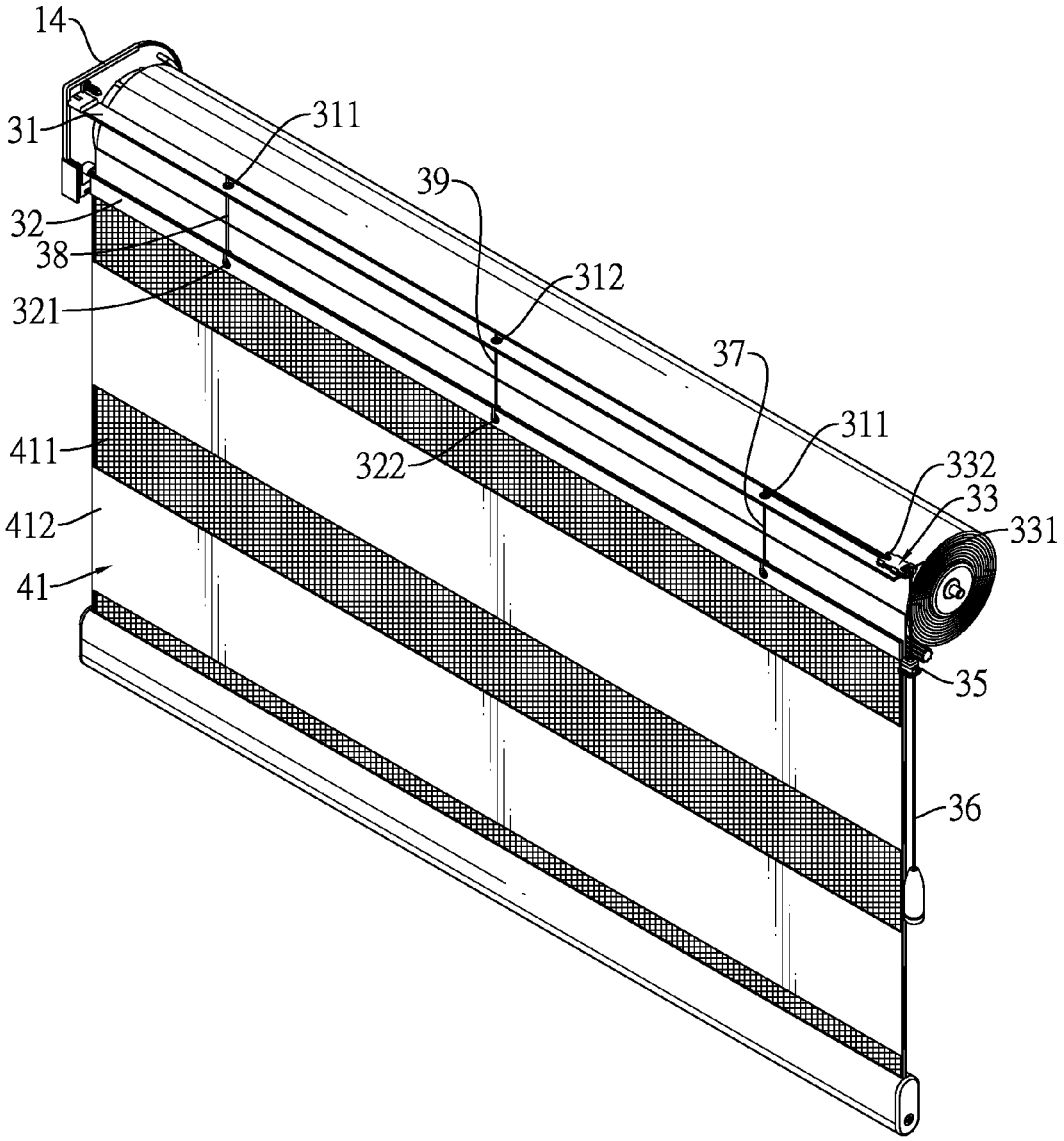
FIG. 5A is a rear perspective view of the light adjusting roller blind device in FIG. 1, wherein a support assembly is omitted.
Figure 5B:
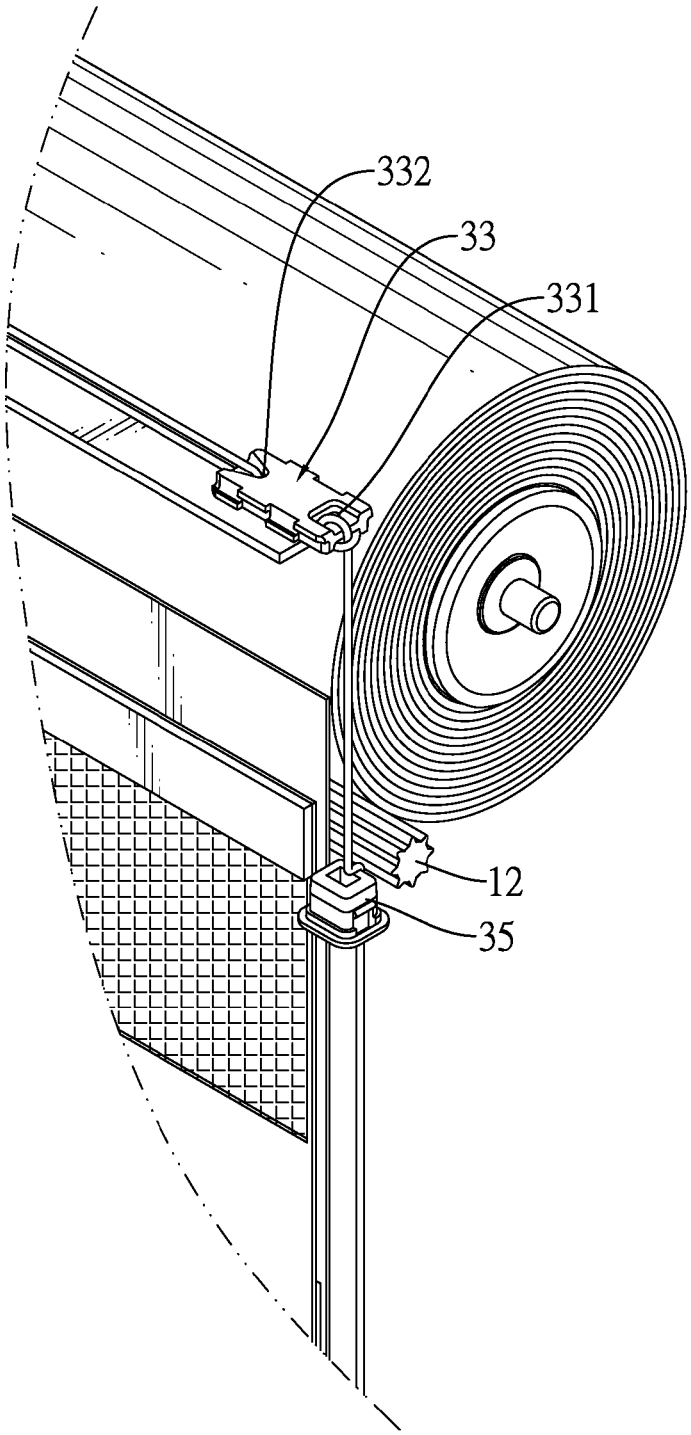
FIG. 5B is an enlarged rear perspective view of the light adjusting roller blind device in FIG. 1, wherein the support assembly is omitted.

With reference to FIGS. 2, 3, and 5A, the reference element 31 is transversely mounted in the support assembly 10. The reference element 31 may be mounted in the support assembly 10 with two opposite ends of the reference element 31 respectively connected to the side supporting brackets 13, 14 of the support assembly 10. Specifically, in the first preferred embodiment, the reference element 31 is mounted through the first mounting recess 111 of the main supporting bracket 11, and has two main penetrable portions 311. The main penetrable portions 311 are separately formed on the reference element 31 and are respectively disposed adjacent to the ends of the reference element 31.

The alignment element 32 is disposed below the reference element 31 and has two main connecting portions 321. The main connecting portions 321 are separately formed on the alignment element 32 and respectively correspond in position to the main penetrable portions 311 of the reference element 31.

With reference to FIGS. 2, 3, and 5A to 6A, the slider 33 is slidably mounted in the second mounting recess 112 of the main supporting bracket 11 of the support assembly 10, and is disposed above the reference element 31 and between one of the main penetrable portions 311 and one of the ends of the reference element 31 that are disposed adjacent to each other. Specifically, the slider 33 is disposed between the first side supporting bracket 13 and one of the penetrable portions 311 that is disposed adjacent to the first side supporting bracket 13. The slider 33 is larger than the main penetrable portion 311 in size. The slider 33 has a linkage end 331 and a connection end 332. The linkage end 331 faces the first side supporting bracket 13. The connection end 332 is opposite to the linkage end 331 and faces the penetrable portion 311 that is disposed adjacent to the first side supporting bracket 13.

Figure 6A:
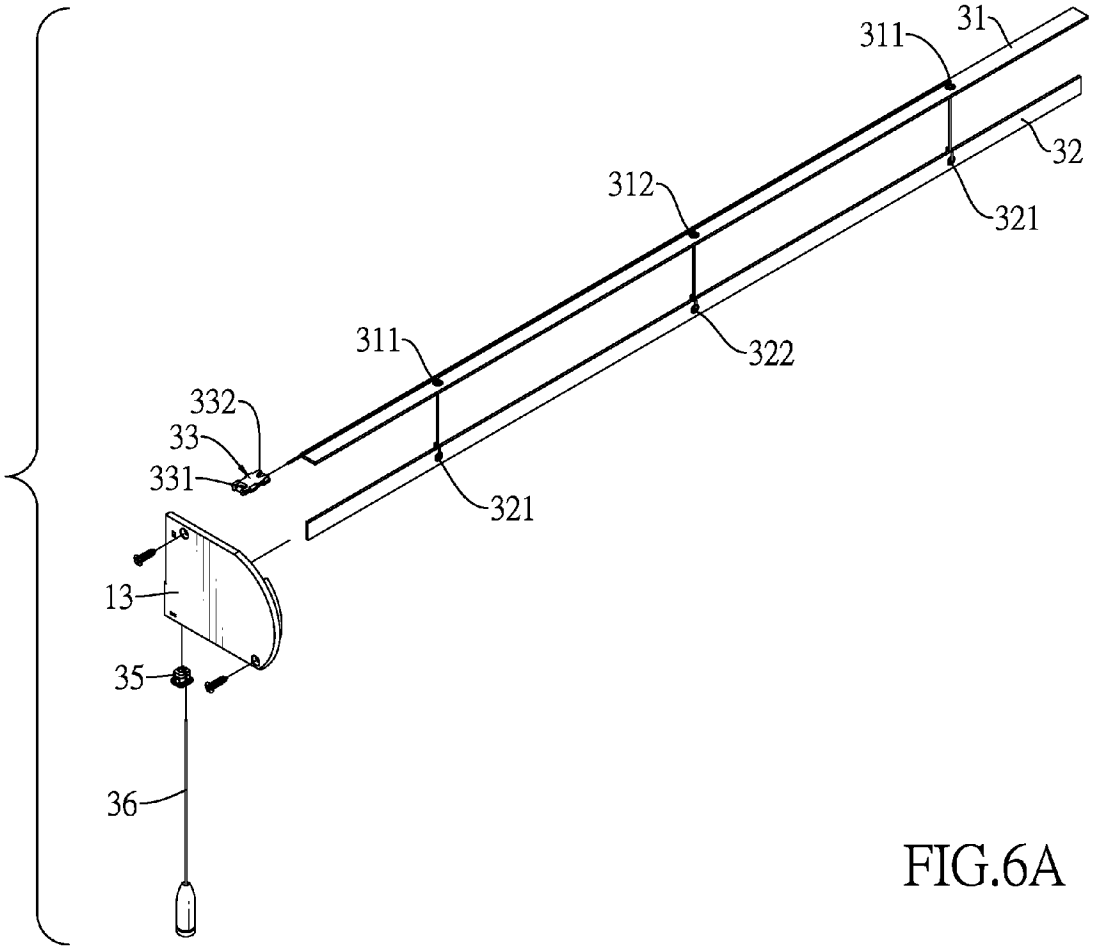
FIG. 6A is another enlarged perspective view of the light adjusting roller blind device in FIG. 1.
Figure 7:
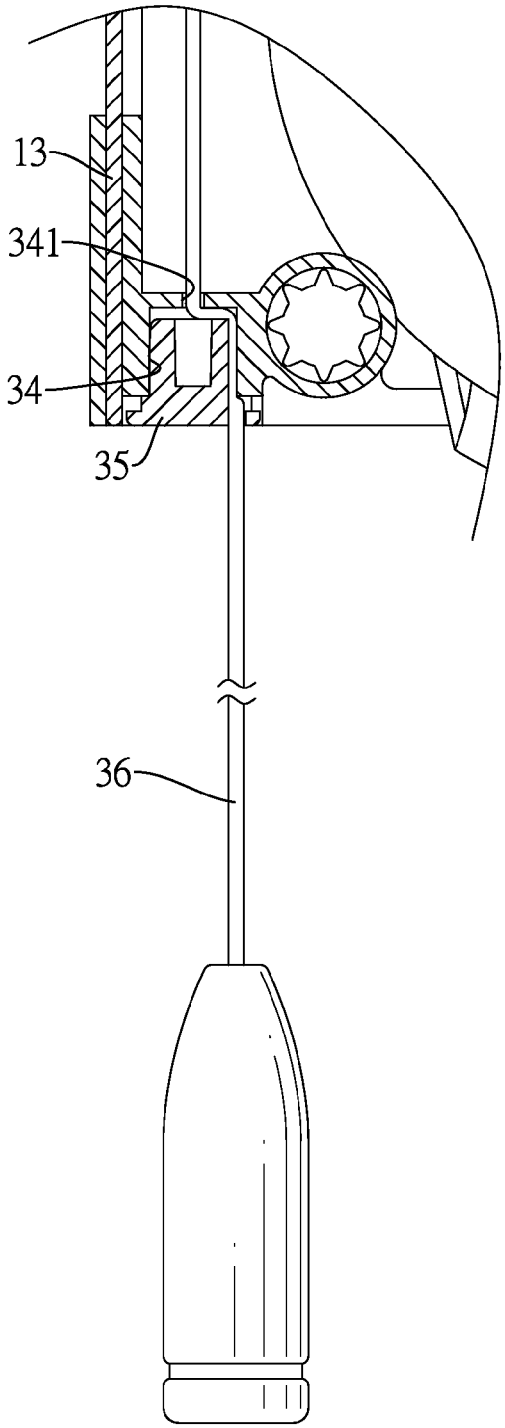
FIG. 7 is an enlarged left side view in partial section of the light adjusting roller blind device in FIG. 1.
Figure 8:
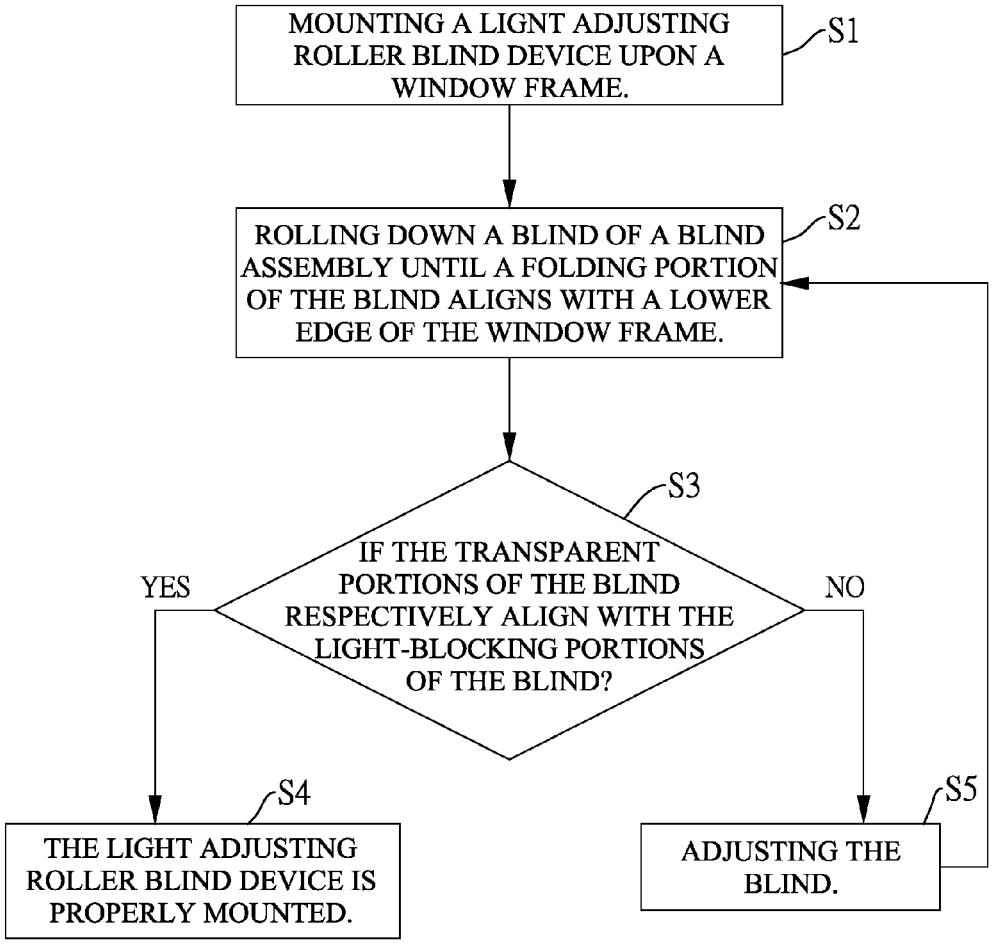
FIG. 8 is a flow chart of a method for mounting the light adjusting roller blind device in FIG. 1 in accordance with the present invention.
Figure 9:
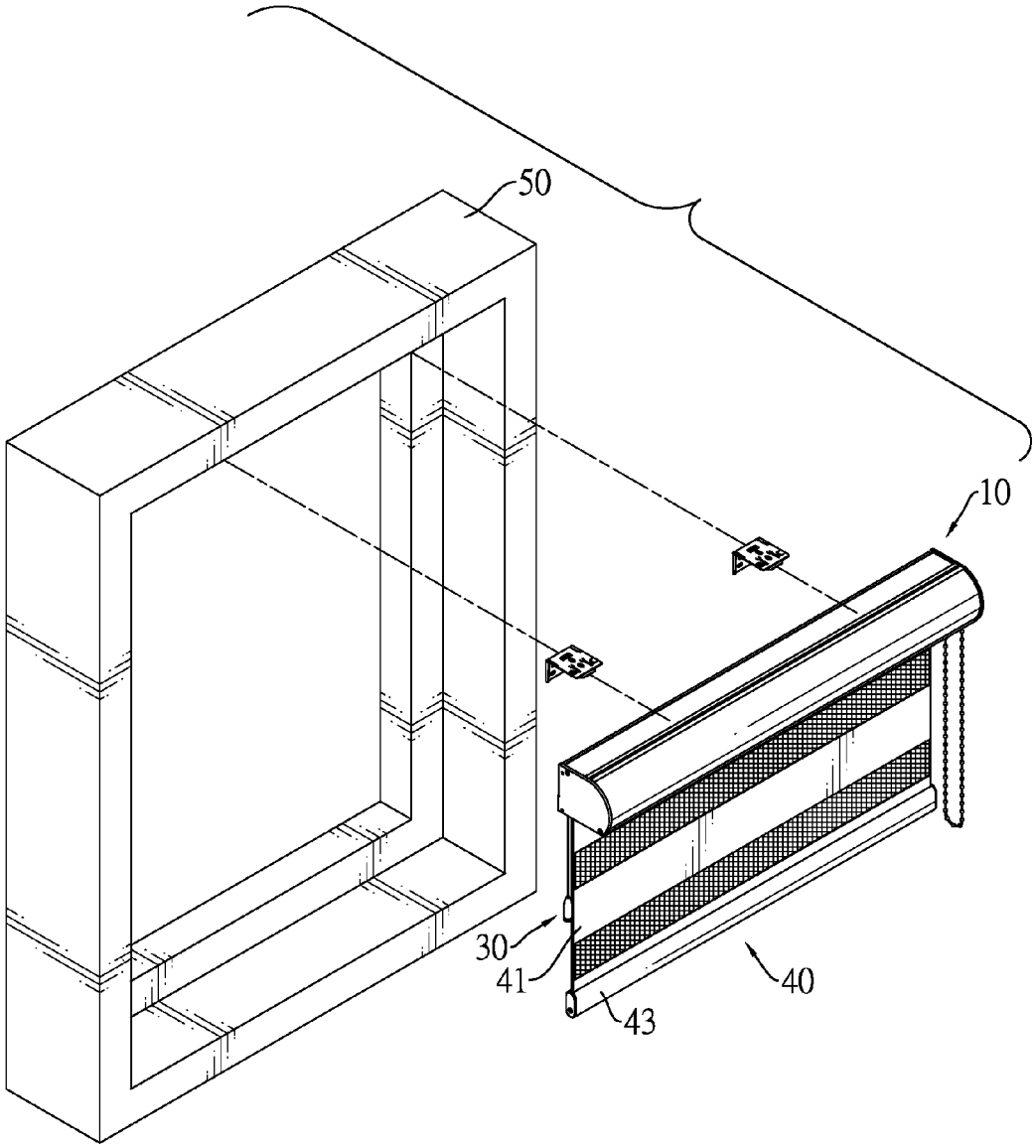
FIGS. 9 and 10 are operational perspective views of the method for mounting the light adjusting roller blind device in FIG. 8, showing the step of mounting the light adjusting roller blind device upon a window frame.
Figure 10:
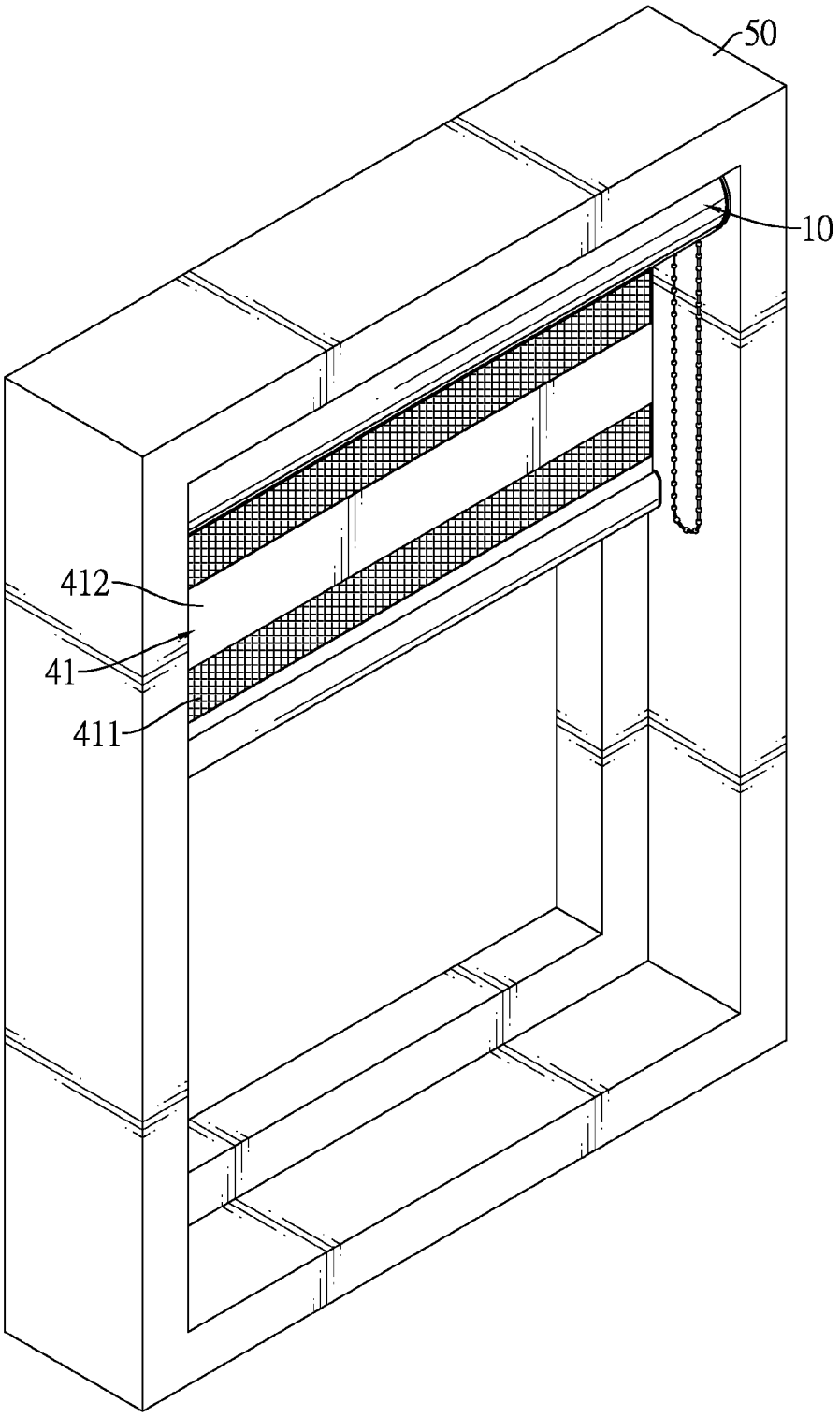

With reference to FIGS. 2, 6A, and 7, the first holding part 34 is disposed on the support assembly 10 adjacent to the slider 33. Specifically, the first holding part 34 is disposed on the first side supporting bracket 13. The second holding part 35 is detachably attached to the first holding part 34.

With reference to FIGS. 2, 5A, and 7, the first rope 36 is held between the first holding part 34 and the second holding part 35 and has two ends. One of the ends of the first rope 36 is securely connected to the linkage end 331 of the slider 33. The other end of the first rope 36 protrudes out of the support assembly 10.

With reference to FIGS. 2, and 5A to 6B, the second rope 37 is mounted through one of the main penetrable portions 311 of the reference element 31 and has two ends and an overlapping segment 371. The ends of the second rope 37 are respectively connected to a corresponding one of the main connecting portions 321 of the alignment element 32 and the connection end 332 of the slider 33.

The third rope 38 is mounted through the other main penetrable portion 311 of the reference element 31 and has two ends and an overlapping segment 381. The ends of the third rope 38 are respectively connected to a corresponding one of the main connecting portions 321 of the alignment element 32 and the connection end 332 of the slider 33, such that the alignment element 32 is hung below the reference element 31. The overlapping segment 381 of the third rope 38 overlaps the overlapping segment 371 of the second rope 37 and is equal to the overlapping segment 371 of the second rope 37 in length.

With reference to FIGS. 5A to 6B, in the first preferred embodiment, the reference element 31 further has an additional penetrable portion 312. The alignment element 32 further has an additional connecting portion 322 corresponding in position to the additional penetrable portion 312 of the reference element 31. The adjusting mechanism 30 further includes an enhancing rope 39. The enhancing rope 39 is mounted through the additional penetrable portion 312 of the reference element 31, and has two ends and an overlapping segment 391. The ends of the enhancing rope 39 are respectively connected to the additional connecting portion 322 of the alignment element 32 and the connection end 332 of the slider 33. The overlapping segment 391 of the enhancing rope 39 overlaps the overlapping segments 371, 381 of the second rope 37 and the third rope 38, and is equal to each of the overlapping segments 371, 381 of the second rope 37 and the third rope 38 in length.

With reference to FIGS. 2 and 5A to 7, specifically, in the first preferred embodiment, the first holding part 34 has a through hole 341. The first rope 36 is mounted through the through hole 341 of the first holding part 34, and is held between the first holding part 34 and the second holding part 35. The second rope 37 and the third rope 38 are integrally formed as a single rope.

With reference to FIGS. 1 and 2, the blind assembly 40 is mounted between the side supporting brackets 13, 14 of the support assembly 10, and is connected to the driving assembly 20 and the adjusting mechanism 30. The blind assembly 40 includes a blind 41, a guiding rod 42, and a retaining weight 43.

With reference to FIGS. 1 to 3, the blind 41 has two opposite end edges, a folding portion 413, multiple transparent portions 411, and multiple light-blocking portions 412. One of the end edges of the blind 41 is connected to and wrapped around the roller 21 of the driving assembly 20. The other end edge of the blind 41 is connected to the alignment element 32 of the adjusting mechanism 30. The folding portion 413 is defined between the end edges of the blind 41 and hangs below the end edges of the blind 41. The folding portion 413 has an interior surface and an exterior surface. The transparent portions 411 and the light-blocking portions 412 are alternately arranged between the end edges of the blind 41.

The guiding rod 42 is transversely mounted in the folding portion 413 of the blind 41 on the interior surface of the blind 41. The retaining weight 43 is mounted on the exterior surface of the folding portion 413 of the blind 41 and holds the guiding rod 42.

When the beaded cord 222 of the rolling mechanism 22 is pulled to drive the chain disk 221 and the roller 21 to rotate, the blind 41 is rolled up or down. With the transparent portions 411 respectively aligning or mis-aligning with the light-blocking portions 412, light transmitted through the blind 41 can be adjusted.

With reference to FIG. 7, the method for mounting the light adjusting roller blind device comprises the following steps.

(a) Mounting the light adjusting roller blind device upon a window frame 50 (S1). With reference to FIGS. 2 and 8 to 10, the support assembly 10 of the light adjusting roller blind device is mounted upon the window frame 50. Accordingly, the driving assembly 20, the adjusting mechanism 30, and the blind assembly 40 that are mounted on the support assembly 10 are also mounted upon the window frame 50.

(b) Inspecting light-blocking effect of the light adjusting roller blind device by rolling down the blind 41 of the blind assembly 40 until the folding portion 413 of the blind 41 aligns with a lower edge of the window frame 50 (S2).

With reference to FIGS. 2, 4, 8, and 10 to 12, the beaded cord 222 of the rolling mechanism 22 of the driving assembly 20 is pulled to drive the chain disk 221 and the roller 21 of the driving assembly 20 to rotate, and to roll the blind 41. When the folding portion 413 of the blind 41 aligns with the lower edge of the window frame 50, if the transparent portions 411 of the blind 41 respectively align with the light-blocking portions 412 of the blind 41, it means that the light adjusting roller blind device is properly mounted upon the window frame 50 (S4).

Figure 11:
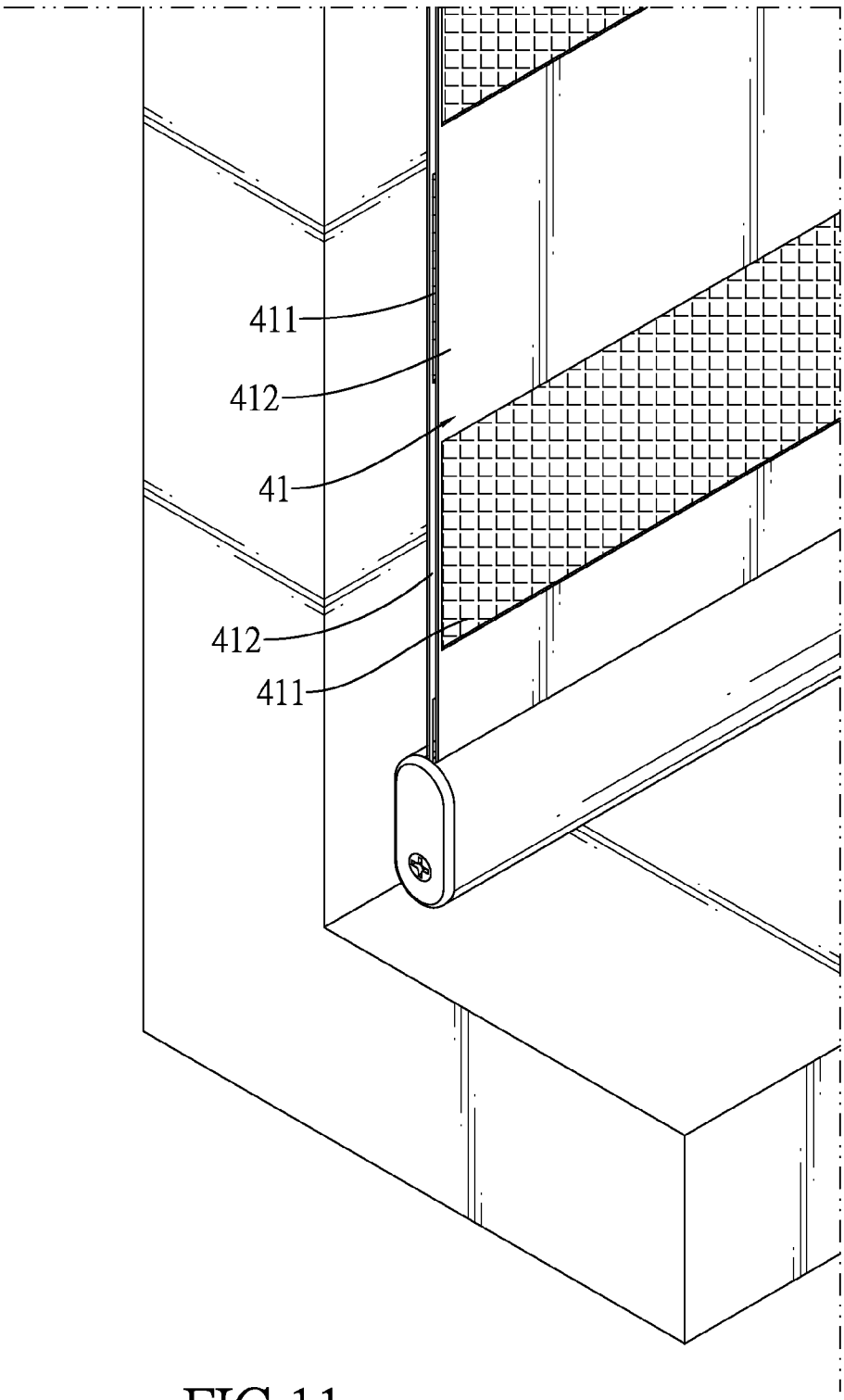
FIGS. 11 and 12 are operational perspective views of the method for mounting the light adjusting roller blind device in FIG. 8, showing the step of inspecting light-blocking effect of the light adjusting roller blind device.
Figure 12:
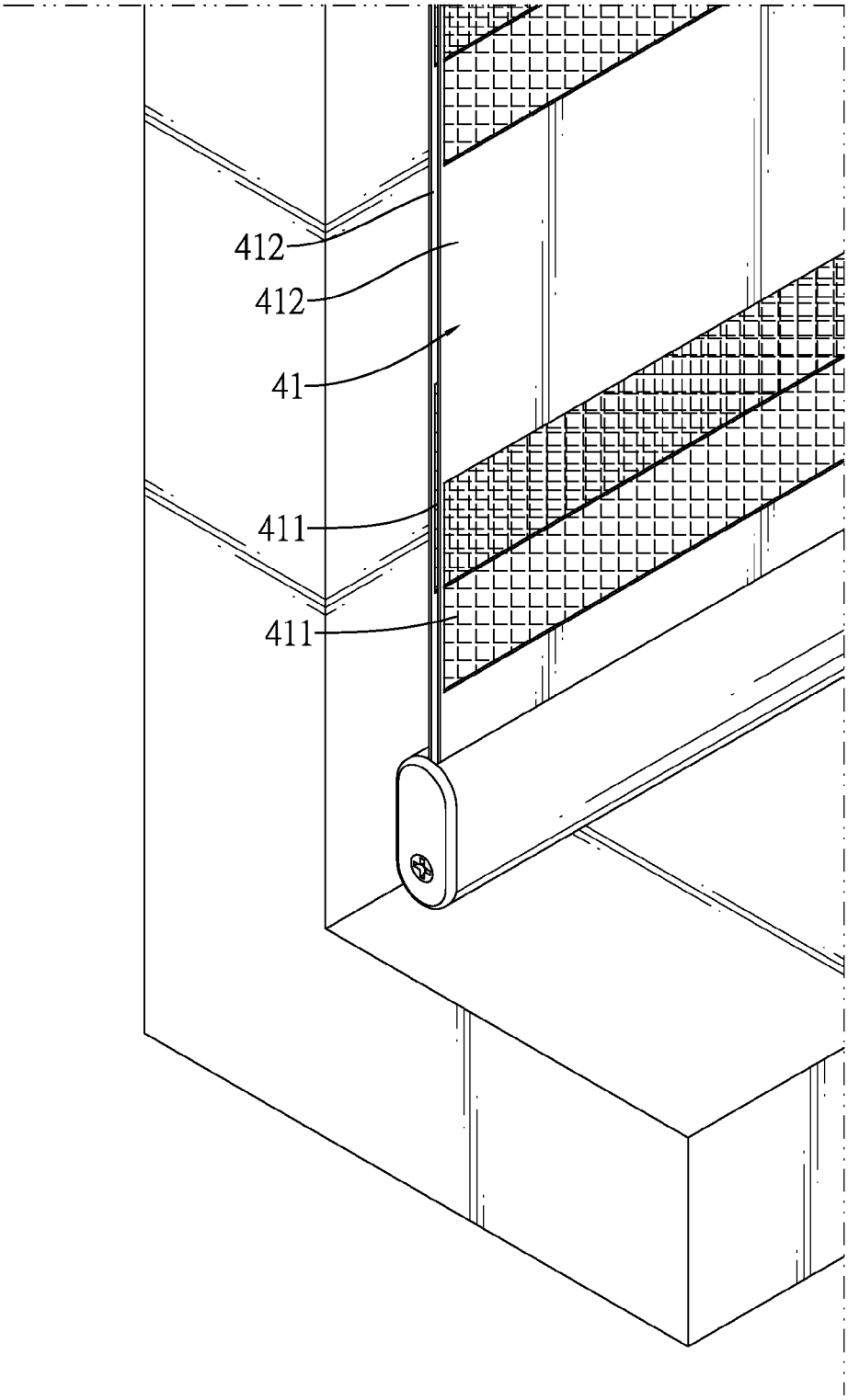
Figure 13:
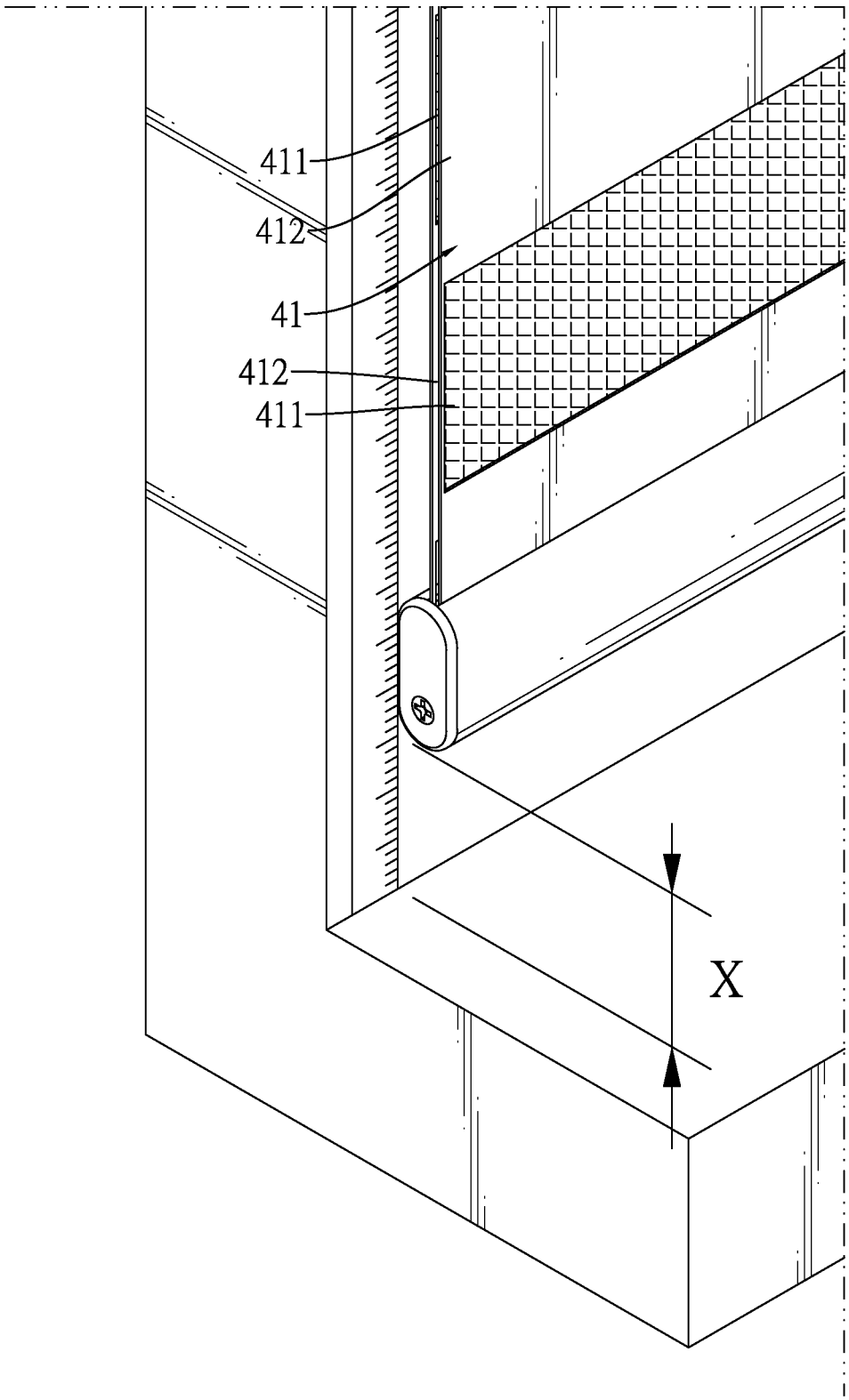
FIGS. 13 to 16 are operational perspective views of the method for mounting the light adjusting roller blind device in FIG. 8, showing the step of adjusting the blind.
Figure 14:
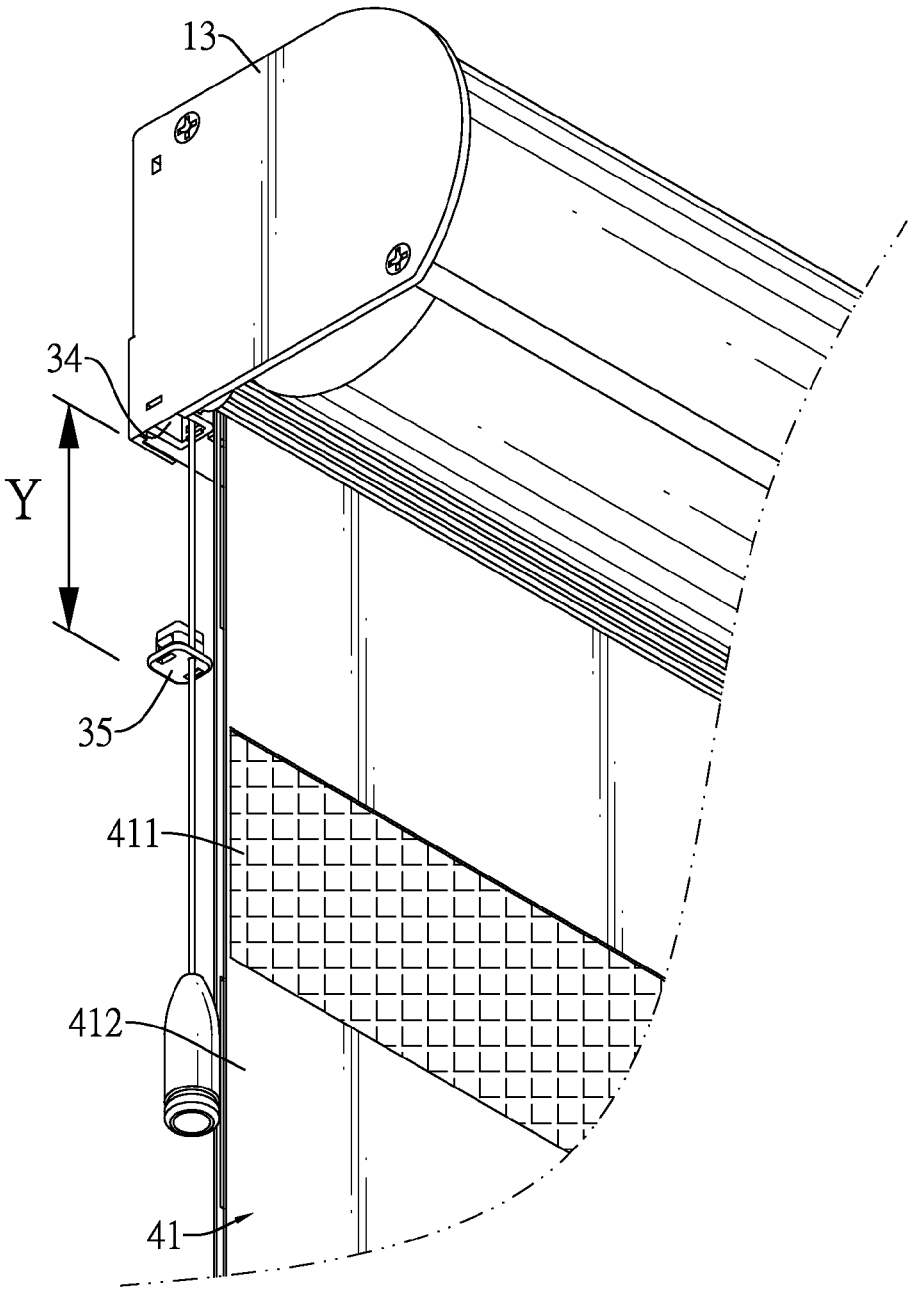
Figure 15:
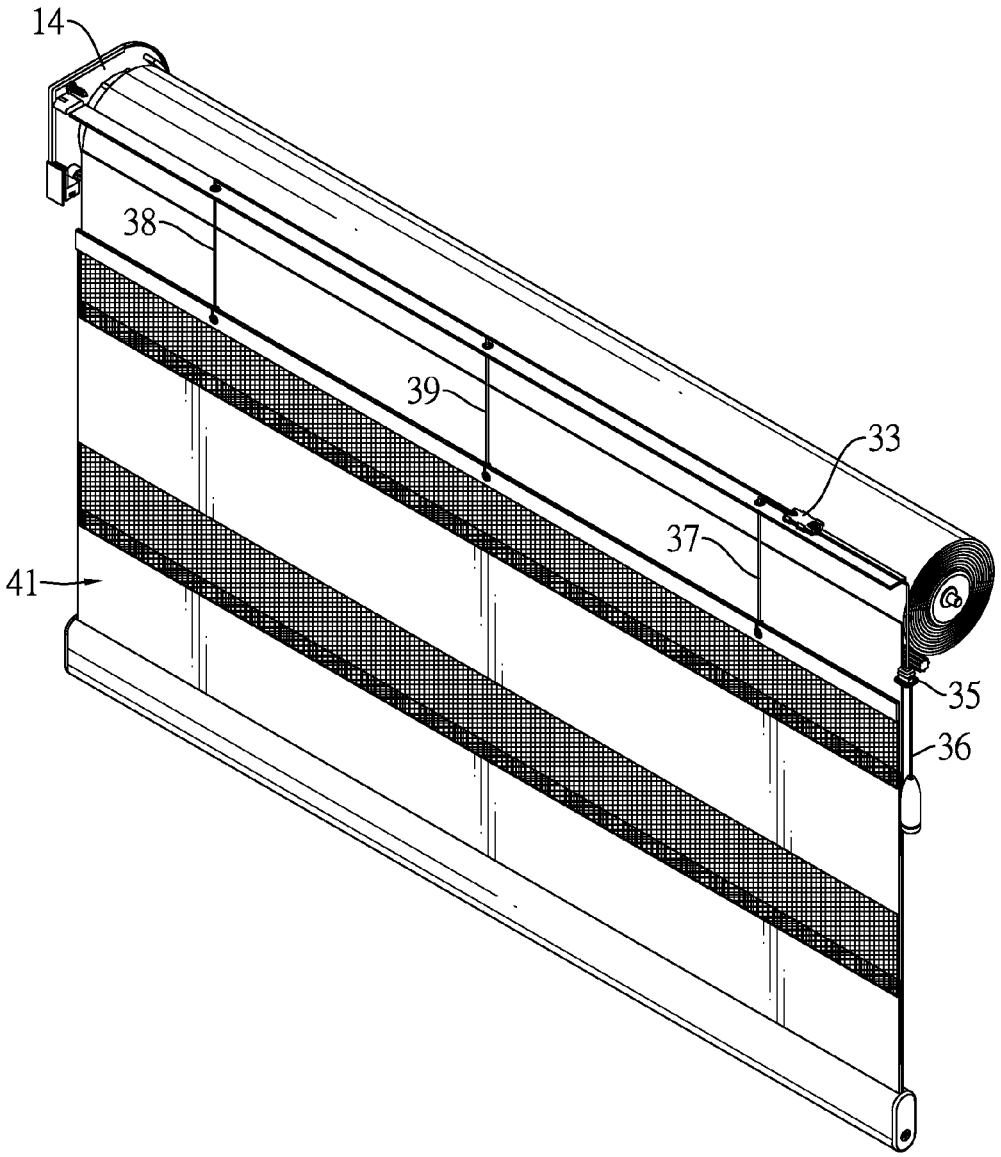
Figure 16:
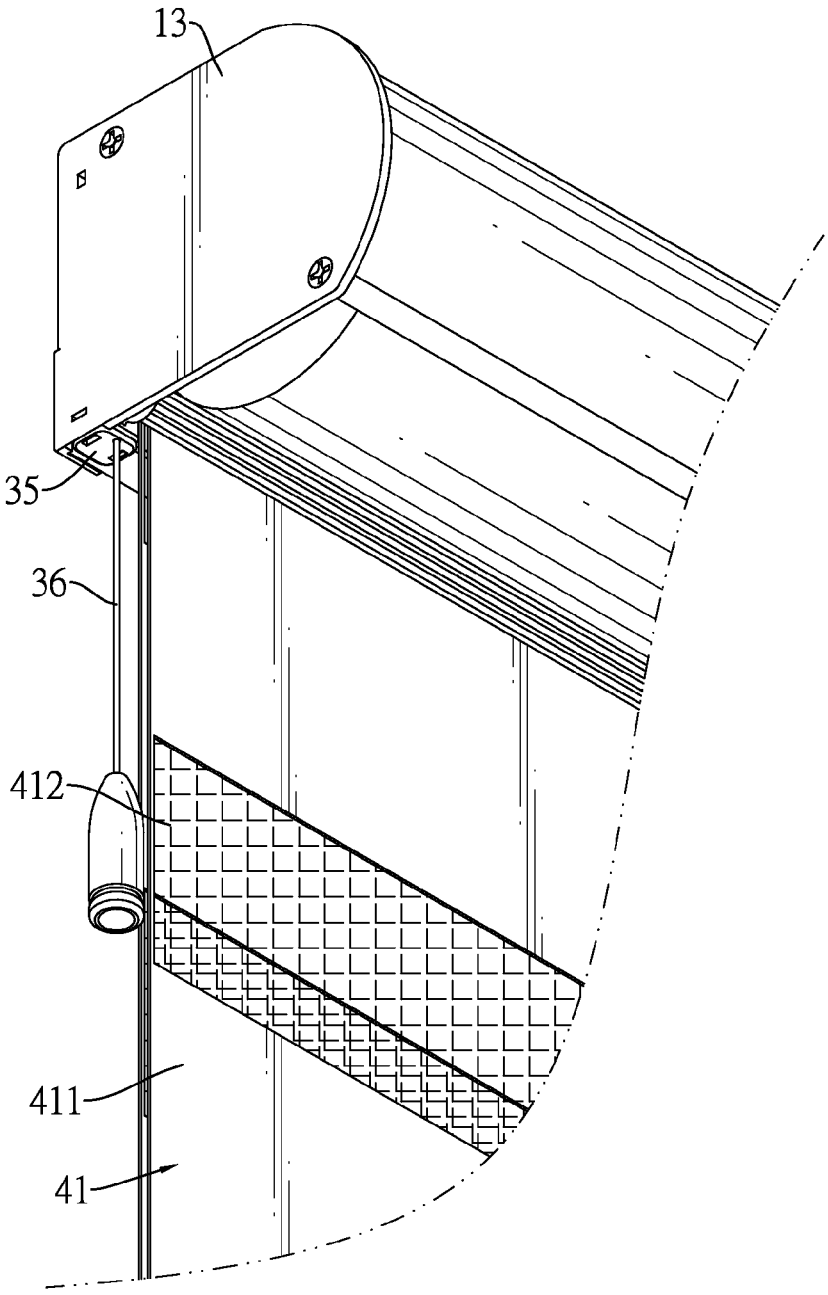

As shown in FIG. 11, as the transparent portions 411 of the blind 41 respectively align with the light-blocking portions 412 of the blind 41, the light cannot transmit through the blind 41.

(c) Adjusting the blind 41 if the transparent portions 411 of the blind 41 respectively mis-align with the light-blocking portions 412 of the blind 41 (S5).

With reference to FIGS. 2, 4, 8, 12, and 13, the beaded cord 222 of the rolling mechanism 22 of the driving assembly 20 is pulled to drive the chain disk 221 and the roller 21 of the driving assembly 20 to rotate, and to roll the blind 41 until the transparent portions 411 of the blind 41 respectively align with the light-blocking portions 412 of the blind 41. A first distance defined between the folding portion 413 of the blind 41 and the lower edge of the window frame 50 is X.

With further reference to FIGS. 3, 5A, 7, and 14 to 16, then the second holding part 35 is detached from the first holding part 34 of the adjusting mechanism 30 to release the first rope 36 of the adjusting mechanism 30 and to roll down the blind 41 of the blind assembly 40 until the folding portion 413 of the blind 41 aligns with the lower edge of the window frame 50. Thus, the slider 33 can slide between the first side supporting bracket 13 of the support assembly 10 and the main penetrable portion 311 that is disposed adjacent to the first side supporting bracket 13.

Figure 6B:
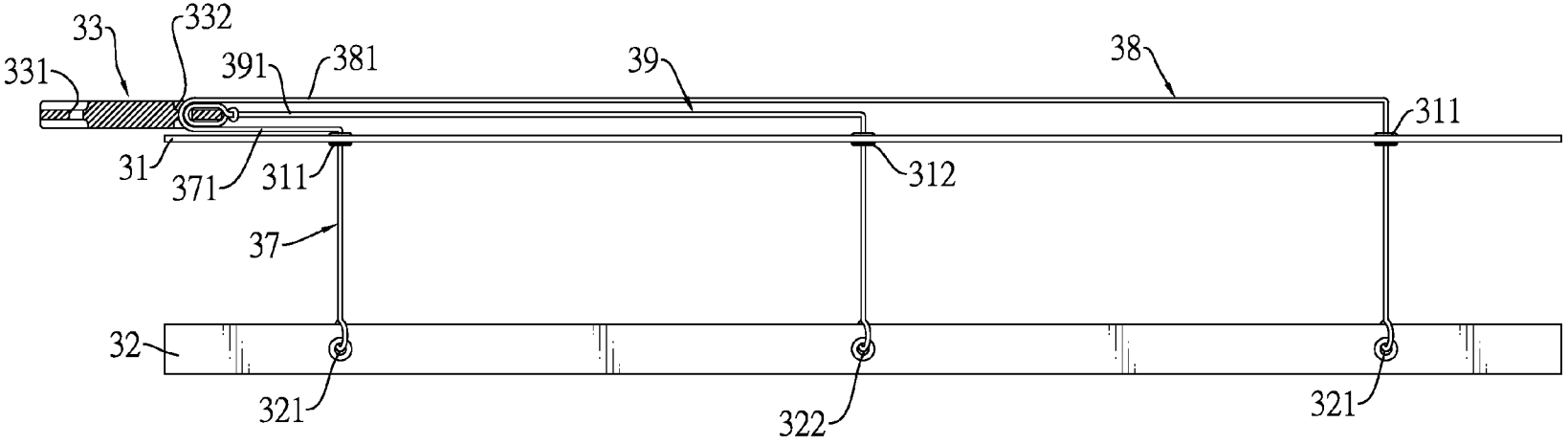
FIG. 6B is an enlarged front view in partial section of the light adjusting roller blind device in FIG. 1.

As shown in FIG. 6B, since the overlapping segments 371, 381, 391 of the second rope 37, the third rope 38, and the enhancing rope 39 are equal in length, when the slider 33 slides between the first side supporting bracket 13 and the main penetrable portion 311 to release the first rope 36 for a second distance Y, the alignment element 32 can be stably lowered by the second distance Y and the blind 41 is kept smooth without becoming oblique.

Then the second holding part 35 is attached to the first holding part 34 again to hold the first rope 36.

(d) Repeating the steps of inspecting the light-blocking effect of the light adjusting roller blind device and adjusting the blind 40 until the light adjusting roller blind device has been properly mounted upon the window frame 50.

Preferably, a first longitudinal length of each of the transparent portions 411 of the blind 41 is defined as P, and a second longitudinal length of each of the light-blocking portions 412 of the blind 41 is defined as Q. When the first longitudinal length P is longer than the second longitudinal length, the relationship between the first distance X, the second distance Y, the first longitudinal length P, and the second longitudinal length Q is $Y=X<0.5(P+Q)$, wherein X, Y, P, and Q are of the same length unit.

Figure 17:
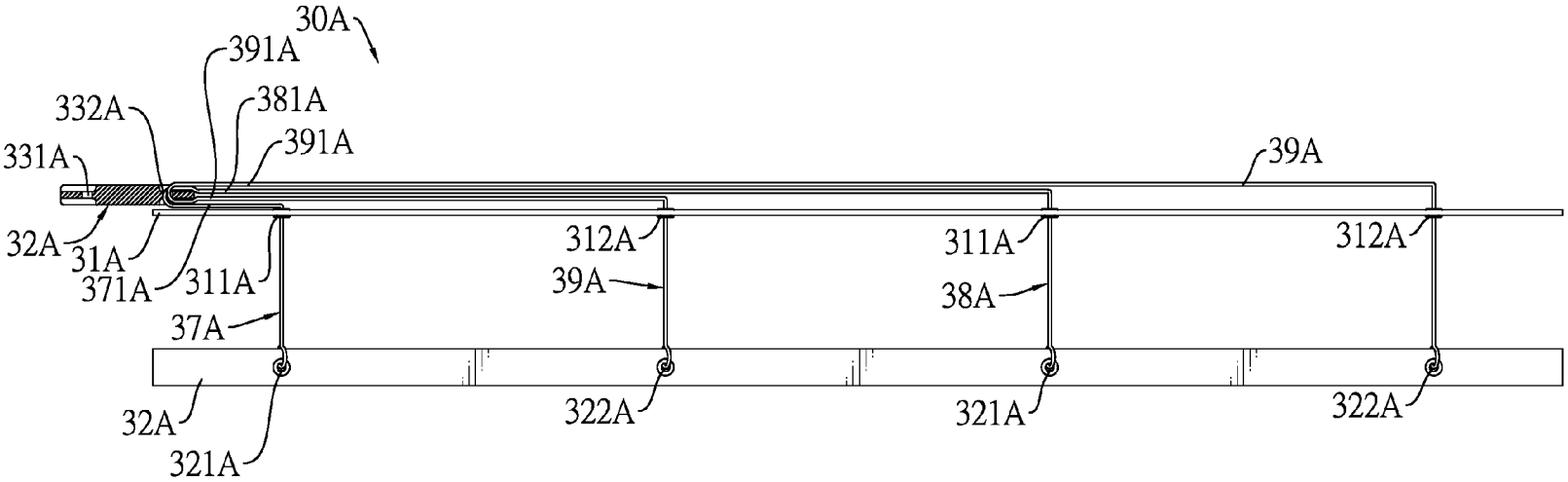
FIG. 17 is an enlarged front view in partial section of a second embodiment of a light adjusting roller blind device in accordance with the present invention.
Figure 18A:
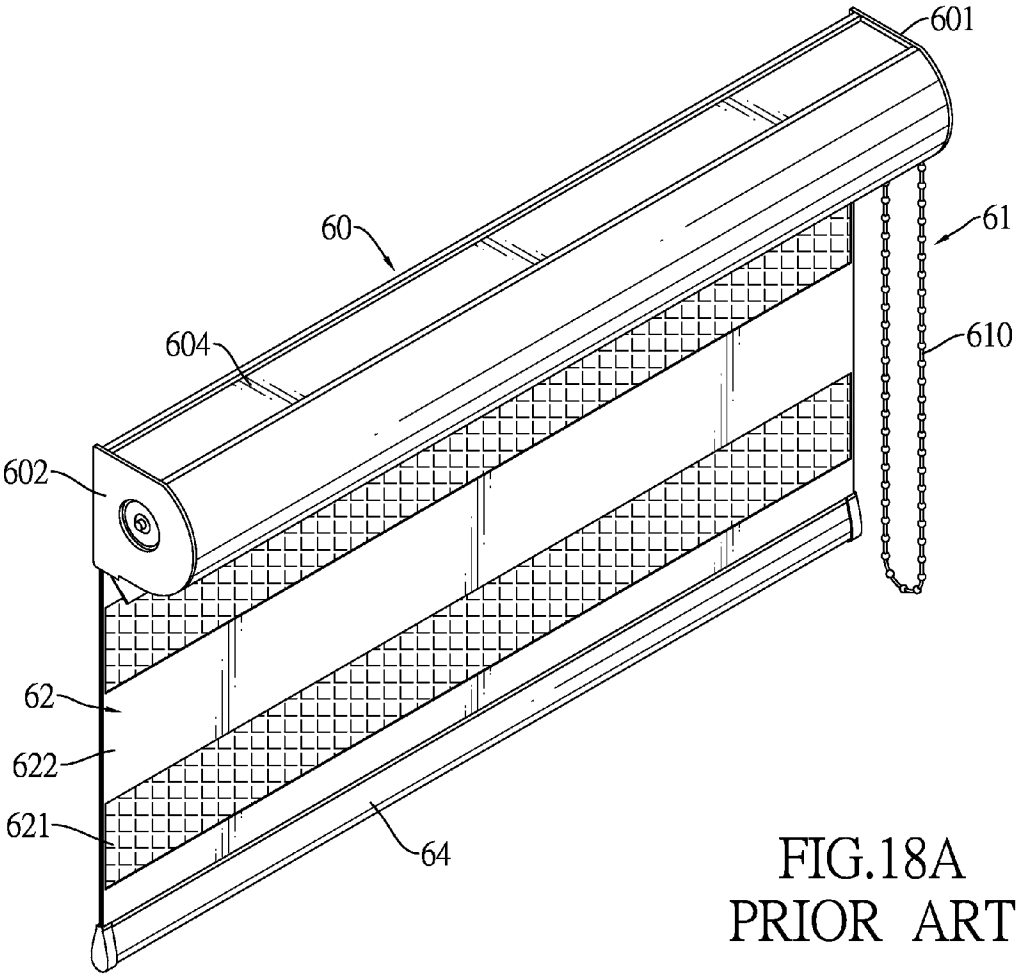
FIG.18A PRIOR ART
FIG. 18A is a perspective view of a conventional light adjusting roller blind device in accordance with the prior art.
Figure 18B:
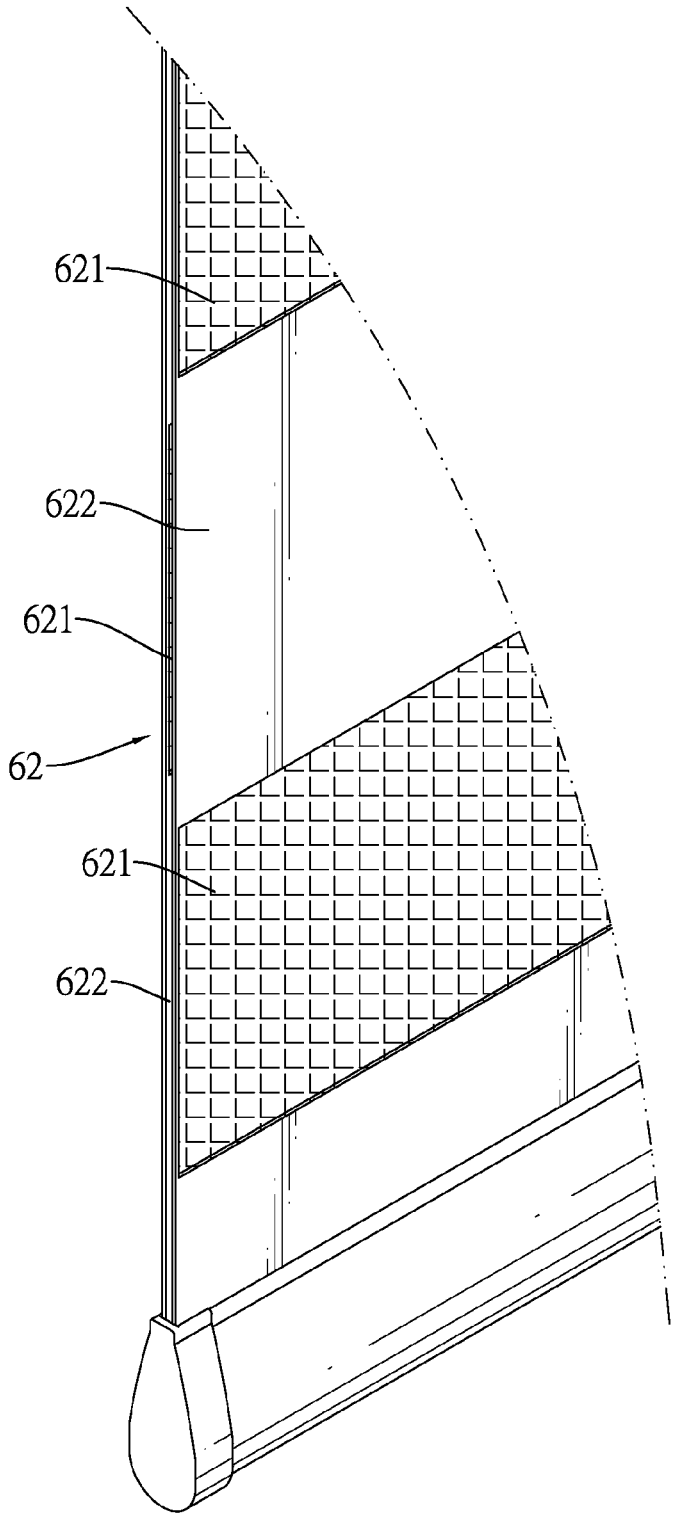
FIG.18B PRIOR ART
FIG. 18B is an enlarged perspective view of the conventional light adjusting roller blind device in FIG. 18A.
Figure 19:
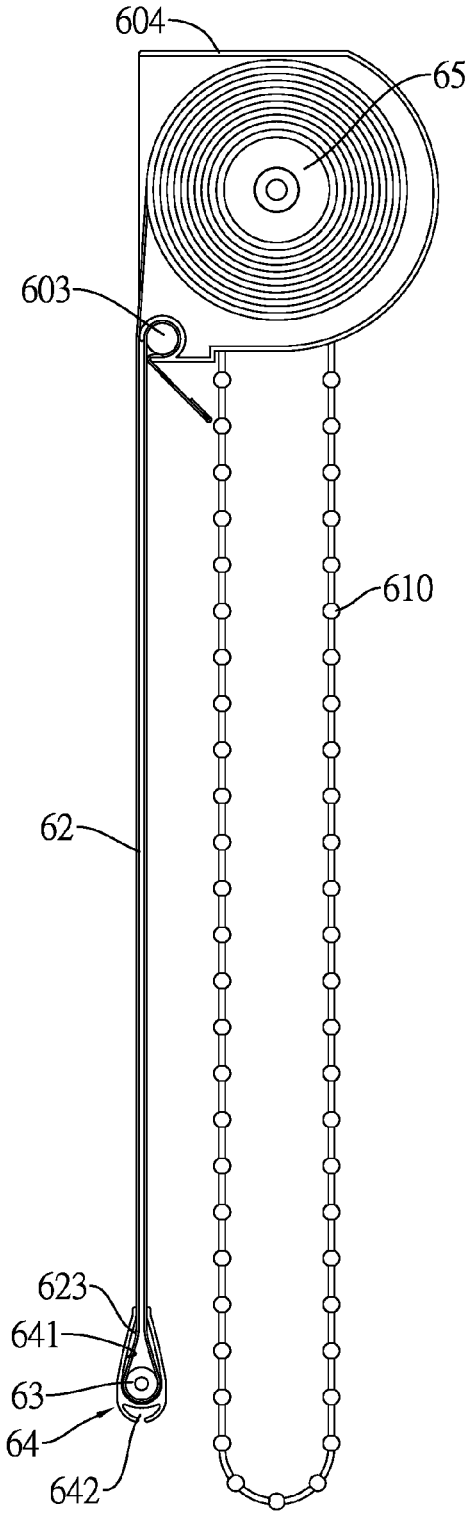
FIG.19 PRIOR ART
FIG. 19 is a left side view of the conventional light adjusting roller blind device in FIG. 18A.
Figure 20:
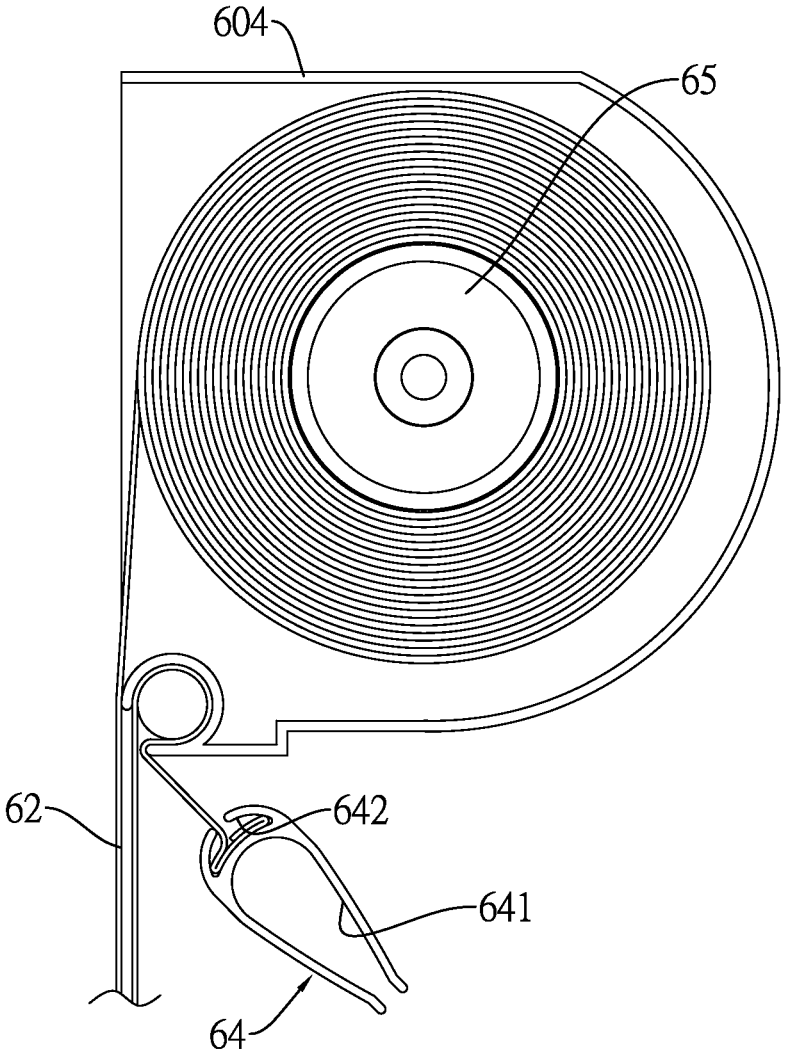
FIG.20 PRIOR ART
FIG. 20 is an enlarged operational left side view of the conventional light adjusting roller blind device in FIG. 18A.

With reference to FIG. 17, in a second preferred embodiment, the reference element 31A of the adjusting mechanism 30A of the light adjusting roller blind device has two additional penetrable portions 312A. The alignment element 32A of the adjusting mechanism 30A of the light adjusting roller blind device has two additional connecting portions 322A respectively corresponding in position to the additional penetrable portions 312A. The adjusting mechanism 30A has two enhancing ropes 39A respectively mounted through the additional penetrable portions 312A of the reference element 31A. The ends of each of the enhancing ropes 39A are respectively connected to a corresponding one of the additional connecting portions 322A of the alignment element 32A and the connection end 332A of the slider 33A. The overlapping segment 391A of the enhancing ropes 39A overlap the overlapping segments 371A, 381A of the second rope 37A and the third rope 38A, and are equal to the overlapping segments 371A, 381A of the second rope 37A and the third rope 38A in length. Preferably, the enhancing ropes 39A may be integrally formed as a single rope. Thus, with the second rope 37A, the third rope 38A, and the enhancing rope 39A, even the blind with increased transverse width can also be stably hung on the alignment element 32A.

The light adjusting roller blind device and the method for mounting the light adjusting roller blind device has the following advantages. With the adjusting mechanism 30 in the support assembly 10, a user can adjust the blind 41 by simply detaching the second holding part 35 from the first holding part 34 and then releasing the first rope 36. Since the overlapping segments 371, 381, 391, 391A of the second rope 37, the third rope 38, and the at least one enhancing rope 39, 39A are equal in length, the alignment element 32 as well as the blind 41 can be stably lowered along with the releasing of the first rope 36. Therefore, it is easy and convenient for the user to adjust the blind 41.

Moreover, as for the blind 41 with enlarged width and weight, the additional penetrable portions 312, 312A of the reference element 31, 31A, the additional connecting portions 322, 322A of the alignment element 32, 32A, and the enhancing rope 39 are helpful in providing additional support to stably hang the blind 41 on the alignment element 32, 32A below the reference element 31, 31A.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A light adjusting roller blind device comprising:

a support assembly;

a driving assembly mounted on the support assembly and including a roller pivotally mounted on the support assembly; and a rolling mechanism mounted between the roller and the support assembly and selectively driving the roller to rotate;

an adjusting mechanism mounted on the support assembly and including a reference element having two opposite ends; and two main penetrable portions separately formed on the reference element and respectively disposed adjacent to the ends of the reference element;

an alignment element disposed below the reference element and having two main connecting portions, and the main connecting portions separately formed on the alignment element and respectively corresponding in position to the main penetrable portions of the reference element;

a slider slidably disposed above the reference element and between one of the main penetrable portions and one of the ends of the reference element that are disposed adjacent to each other, the slider being larger than the main penetrable portions in size, and the slider having a linkage end and a connection end;

a first holding part disposed on the support assembly adjacent to the slider;

a second holding part detachably attached to the first holding part;

a first rope held between the first holding part and the second holding part and having two ends, one of the ends of the first rope securely connected to the linkage end of the slider, and the other end of the first rope protruding out of the support assembly;

a second rope mounted through one of the main penetrable portions of the reference element and having two ends respectively connected to a corresponding one of the main connecting portions of the alignment element and the connection end of the slider; and an overlapping segment; and a third rope mounted through the other main penetrable portion of the reference element and having two ends respectively connected to a corresponding one of the main connecting portions of the alignment element and the connection end of the slider; and an overlapping segment overlapping the overlapping segment of the second rope and being equal to the overlapping segment of the second rope in length; and a blind assembly mounted in the support assembly and connected to the driving assembly and the adjusting mechanism, and the blind assembly including a blind having two opposite end edges, one of the end edges of the blind connected to and wrapped around the roller, and the other end edge of the blind connected to the alignment element of the adjusting mechanism;

a folding portion defined between the end edges of the blind and having an interior surface and an exterior surface;

multiple transparent portions; and multiple light-blocking portions, the transparent portions and the light-blocking portions alternately arranged between the end edges of the blind;

a guiding rod transversely mounted in the folding portion of the blind on the interior surface of the blind; and a retaining weight mounted on the exterior surface of the folding portion of the blind and holding the guiding rod.

2. The light adjusting roller blind device as claimed in claim 1, wherein the support assembly includes two side supporting brackets disposed apart from each other;

the roller of the driving assembly is pivotally mounted between and on the side supporting brackets of the support assembly;

the rolling mechanism of the driving assembly is mounted between the roller and one of the side supporting brackets of the support assembly;

the ends of the reference element of the adjusting mechanism are respectively connected to the side supporting brackets of the support assembly;

the slider of the adjusting mechanism is disposed between one of the side supporting brackets and one of the penetrable portions that is disposed adjacent to said one of the side supporting brackets;

the linkage end of the slider faces the side supporting bracket that is disposed beside the slider;

the connection end of the slider faces the penetrable portion that is disposed beside the slider; and the first holding part of the adjusting mechanism is disposed on the side supporting bracket that is disposed beside the slider.

3. The light adjusting roller blind device as claimed in claim 1, wherein the support assembly further includes a main supporting bracket having a first mounting recess transversely extending; and a second mounting recess transversely extending, and disposed beside and communicating with the first mounting recess;

the reference element of the adjusting mechanism is mounted through the first mounting recess of the main supporting bracket; and the slider of the adjusting mechanism is slidably mounted in the second mounting recess of the main supporting bracket.

4. The light adjusting roller blind device as claimed in claim 2, wherein the support assembly further includes a main supporting bracket having two opposite ends respectively connected to the side supporting brackets;

a first mounting recess transversely extending; and a second mounting recess transversely extending, and disposed beside and communicating with the first mounting recess;

the reference element of the adjusting mechanism is mounted through the first mounting recess of the main supporting bracket; and the slider of the adjusting mechanism is slidably mounted in the second mounting recess of the main supporting bracket.

5. The light adjusting roller blind device as claimed in claim 2, wherein the first holding part of the adjusting mechanism has a through hole; and the first rope is mounted through the through hole of the first holding part, and is held between the first holding part and the second holding part.

6. The light adjusting roller blind device as claimed in claim 4, wherein the first holding part of the adjusting mechanism has a through hole; and the first rope is mounted through the through hole of the first holding part, and is held between the first holding part and the second holding part.

7. The light adjusting roller blind device as claimed in claim 1, wherein the reference element further has an additional penetrable portion;

the alignment element further has an additional connecting portion corresponding in position to the additional penetrable portion of the reference element; and the adjusting mechanism further includes an enhancing rope mounted through the additional penetrable portion of the reference element and having two ends respectively connected to the additional connecting portion of the alignment element and the connection end of the slider; and an overlapping segment overlapping the overlapping segments of the second rope and the third rope, and being equal to each of the overlapping segments of the second rope and the third rope in length.

8. The light adjusting roller blind device as claimed in claim 2, wherein the reference element further has an additional penetrable portion;

the alignment element further has an additional connecting portion corresponding in position to the additional penetrable portion of the reference element; and the adjusting mechanism further includes an enhancing rope mounted through the additional penetrable portion of the reference element and having two ends respectively connected to the additional connecting portion of the alignment element and the connection end of the slider; and an overlapping segment overlapping the overlapping segments of the second rope and the third rope, and being equal to each of the overlapping segments of the second rope and the third rope in length.

9. The light adjusting roller blind device as claimed in claim 3, wherein the reference element further has an additional penetrable portion;

the alignment element further has an additional connecting portion corresponding in position to the additional penetrable portion of the reference element; and the adjusting mechanism further includes an enhancing rope mounted through the additional penetrable portion of the reference element and having two ends respectively connected to the additional connecting portion of the alignment element and the connection end of the slider; and an overlapping segment overlapping the overlapping segments of the second rope and the third rope, and being equal to each of the overlapping segments of the second rope and the third rope in length.

10. The light adjusting roller blind device as claimed in claim 4, wherein the reference element further has an additional penetrable portion;

the alignment element further has an additional connecting portion corresponding in position to the additional penetrable portion of the reference element; and the adjusting mechanism further includes an enhancing rope mounted through the additional penetrable portion of the reference element and having two ends respectively connected to the additional connecting portion of the alignment element and the connection end of the slider; and an overlapping segment overlapping the overlapping segments of the second rope and the third rope, and being equal to each of the overlapping segments of the second rope and the third rope in length.

11. The light adjusting roller blind device as claimed in claim 5, wherein the reference element further has an additional penetrable portion;

the alignment element further has an additional connecting portion corresponding in position to the additional penetrable portion of the reference element; and the adjusting mechanism further includes an enhancing rope mounted through the additional penetrable portion of the reference element and having two ends respectively connected to the additional connecting portion of the alignment element and the connection end of the slider; and an overlapping segment overlapping the overlapping segments of the second rope and the third rope, and being equal to each of the overlapping segments of the second rope and the third rope in length.

12. The light adjusting roller blind device as claimed in claim 6, wherein the reference element further has an additional penetrable portion;

the alignment element further has an additional connecting portion corresponding in position to the additional penetrable portion of the reference element; and the adjusting mechanism further includes an enhancing rope mounted through the additional penetrable portion of the reference element and having two ends respectively connected to the additional connecting portion of the alignment element and the connection end of the slider; and an overlapping segment overlapping the overlapping segments of the second rope and the third rope, and being equal to each of the overlapping segments of the second rope and the third rope in length.

13. A method for mounting the light adjusting roller blind device as claimed in claim 1, the method comprising steps of:

(a) mounting the light adjusting roller blind device upon a window frame;

(b) inspecting a light-blocking effect of the light adjusting roller blind device by rolling down the blind of the blind assembly until the folding portion of the blind aligns with a lower edge of the window frame, wherein when the folding portion of the blind aligns with the lower edge of the window frame, if the transparent portions of the blind respectively align with the light-blocking portions of the blind, the light adjusting roller blind device is properly mounted upon the window frame;

(c) adjusting the blind if the transparent portions of the blind respectively mis-align with the light-blocking portions of the blind, wherein the driving assembly is driven to roll the blind until the transparent portions of the blind respectively align with the light-blocking portions of the blind;

the second holding part is detached from the first holding part of the adjusting mechanism to release the first rope of the adjusting mechanism and to roll down the blind of the blind assembly until the folding portion of the blind aligns with the lower edge of the window frame; and the second holding part is attached to the first holding part again to hold the first rope; and (d) repeating the steps of inspecting the light-blocking effect of the light adjusting roller blind device and adjusting the blind until the light adjusting roller blind device has been properly mounted upon the window frame.

* * * * *